US005180105A

United States Patent [19]

Teague

[11] Patent Number: 5,180,105

[45] Date of Patent: Jan. 19, 1993

[54] SNOW MAKING APPARATUS

[75] Inventor: W. Dorwin Teague, 155 Tweed Blvd., Nyack, N.Y. 10960

[73] Assignee: Dorwin Teague, Nyack, N.Y.

[21] Appl. No.: 661,550

[22] Filed: Feb. 26, 1991

[51] Int. Cl.[5] ..... F25C 3/04

[52] U.S. Cl. ..... 239/14.2; 239/407; 239/417.3

[58] Field of Search ..... 239/14.2, 2.2, 405, 239/407, 417.3

[56] References Cited

U.S. PATENT DOCUMENTS 3,494,559 2/1970 Skinner ..... 239/14.2

4,353,504 10/1982 Girardin et al. ..... 239/14.2

*Primary Examiner*—Andres Kashnikow

*Assistant Examiner*—Lesley D. Morris

*Attorney, Agent, or Firm*—Fitzpatrick, Cella, Harper & Scinto

[57] ABSTRACT

An improved apparatus for producing snow is disclosed which includes a hollow water supply body having an integral water discharge throat formed therein at its front end and containing a needle valve assembly mounted at its rear end with an adjustable needle concentrically aligned with the orifice to control water flow through the orifice. A hollow air supply body is mounted on and receives the front end of the water supply body to receive water from the water supply body. The air supply body has an outlet orifice mounted thereon for discharging a mixture of air and water to a mixing tube for discharge to the atmosphere. Each of these components is clamped together in a single composite unitary construction with the bores and passage ways therein held in axially alignment by a plurality of clamping bolts.

23 Claims, 5 Drawing Sheets

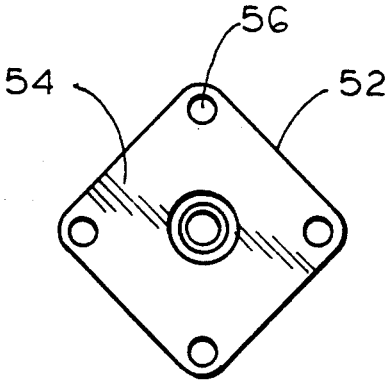
FIG. 5
FIG. 6
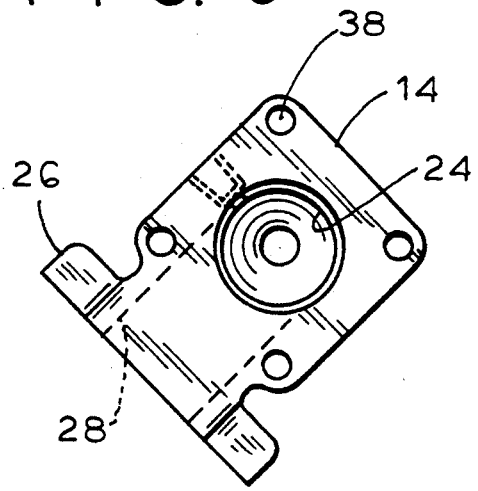
FIG. 7
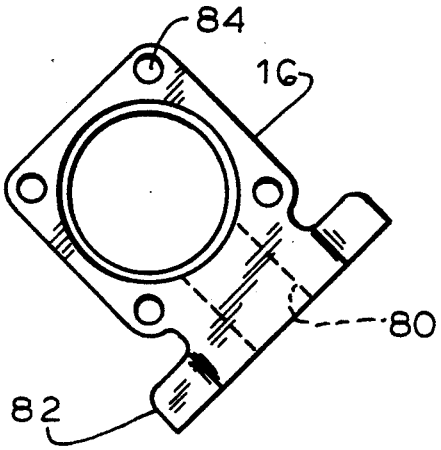
FIG. 8
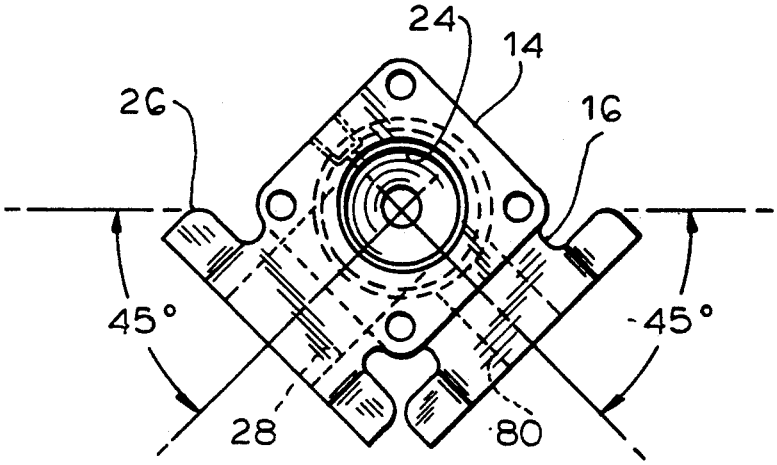

SNOW MAKING APPARATUS

The present invention relates to apparatus for making snow using relatively low pressure compressed air, and more particularly to an improved apparatus for making snow of the general type described in U.S. Pat. No. 4,916,911.

BACKGROUND OF THE INVENTION

In the United States and many foreign countries, ski areas utilize snow making apparatus to supplement natural snow fall. Even in high altitude locations with normally high precipitation rates, ski area operators rely on regular snow making to maintain trails and slopes in good condition after the wear and tear of heavy ski activity. In areas further south, with lower altitudes, snow making apparatus means the difference between staying open all winter and shutting down for part of the season. Thus, snow making is a vital part of almost all ski area operations.

Heretofore, snow making methods and apparatus have generally been classified as "air/water" and "airless" types. The prior art "air/water" type snow making apparatus required compressed or pressurized air at relatively high air pressures of up to 100 PSIG or more. So-called "airless" types of snow making apparatus do not use compressed air but used fans to disburse water droplets into the air instead. Such devices are shown for example in U.S. Pat. Nos. 2,676,471 and 2,968,164.

While such devices have been used for many years, they have been found to suffer from a variety of inadequacies. Generally the airless type devices operate well at lower temperatures of less than 24° F. while the high pressure "air/water" type devices operate well only up to 28° F. In addition, the high pressure "air/water" devices are disadvantageous because of the relatively high air pressures needed for their operations.

In order to overcome these deficiencies, an improved snow making apparatus and process was developed as disclosed in U.S. Pat. No. 4,916,911. In accordance with the method and apparatus disclosed in that patent, improved snow making was achieved by a process which provides a stream of pressurized air at low pressure in the general range of 30 psi, a stream of pressurized water, and which combines the air and water streams to produce a mixture of air and water. The snow making apparatus or gun illustrated in the drawings of that patent includes an initial aspiration of air to form a stream of air and water, and then that stream is mixed with ambient air to form a second stream that is disbursed into the atmosphere. In addition, the apparatus of U.S. Pat. No. 4,916,911 uses a nucleating agent to promote freezing of the water in the discharged mixture stream at the discharge end of the apparatus.

The snow making apparatus disclosed in U.S. Pat. No. 4,916,911 has numerous advantages, the principal of which is the ability to produce high volumes of high quality snow at relatively low air pressures of 30 psig. However, the construction of the apparatus illustrated in that patent is relatively complex, with multiple parts. It is important in the operation of that device that the various components be maintained in axial alignment, because the velocity of the air and water passing through the apparatus approaches sonic speeds. However, the complexity of these devices construction makes such alignment difficult to achieve and then maintain. Moreover, the construction of the snow making apparatus disclosed in that patent makes assembly and disassembly for repair purposes difficult.

Another problem with existing snow guns of all types is that they will not make snow spontaneously in most conditions. To solve this problem a so-called nucleator is usually added to the snow gun, as is done in the apparatus of U.S. Pat. No. 4,916,911. The nucleator is, in effect, a miniature air/water gun which operates at an extremely high air to water ratio. It produces ice crystals at temperature up to 32° F. which are directed into the plume from the airless or air/water gun. This has a catalyzing effect which triggers the plume into making snow. This effect is due to the temperature well below freezing but ice will not form until a single ice crystal has been introduced. The use of necleators introduces an additional expense and complexity to snow making.

According, it is an object of the present invention to provide an improved snow making apparatus which is highly efficient over a wide range of temperatures, particularly at relatively high snow making temperatures.

Another object of the present invention is to provide a snow making apparatus which will produce improved quality and quantities of snow, yet which is relatively lightweight in construction and easy to assemble and dissemble.

Another object of the present invention is to provide a snow making apparatus which is simple to construct and has substantially zero leakage of air or water.

Yet another object of the present invention is to provide a construction for a snow making apparatus which insures concentricity of the components thereof that contain the high speed and relatively high pressure air and water during the snow making process.

SUMMARY OF THE INVENTION

In accordance with an aspect of the present invention a snow making apparatus or gun is provided which consists of a plurality of components concentrically aligned along the longitudinal axis of the gun. These components include a water supply body having a water inlet port and a rounded edge water outlet orifice integrally formed therewith. The water outlet orifice is located concentric with the longitudinal axis and includes a rounded approach which curves from a first larger diameter in the body to a smaller diameter throat at the face of the orifice. A needle guide housing is contained at least partly in the water supply body and is concentric therewith. A needle valve is movably mounted in the needle guide housing and has a tapered end extending from the housing towards the orifice. The needle is adjustably mounted so that the position of its tapered end relative to the orifice can be adjusted to control the flow of water under pressure from the water supply body through the orifice.

A second hollow air supply body having front and rear ends portions is arranged concentrically with the water supply body. The air supply body receives within its rear end the integral orifice of the water supply body and has an air inlet port formed therein. An rounded edge outlet orifice is mounted in the front end of the air supply body for discharging a mixture of air and water from the air supply body. The outlet orifice in the air supply body includes a rounded approach which curves from a first diameter to a second smaller diameter throat downstream. A mixing tube bracket is mounted on the air supply body. The mixing tube bracket has a piloted inner end portion which is received in the front end of the air supply body concentrically with the orifice therein. A mixing tube having an internal diameter which is substantially equal to the smaller diameter of the throat of the orifice in the air supply body is mounted in the bracket concentrically with the orifice. All these components are then clamped together to form a composite unitized structure by a plurality of bolts extending generally parallel to the longitudinal axis of the apparatus.

This construction of snow making apparatus has been found to produce improved snow making results. It has been built and operated and found to make snow under all test conditions at 30 psi air pressure without requiring an external nucleator device or any chemical additives. It has been found that the apparatus has the ability to make snow at temperatures as high as 43° F. and fifty percent relative humidity with the water pressure supplied to the apparatus at 300 psi and air pressure at 30 psi. At 25° F. ambient temperature the apparatus of the present invention has made 29 pounds per cubic foot density snow at a rate of 50 GPM water flow.

An important aspect of the invention is the ability to make high quality snow and high quantities thereof at relatively low pressures. It is known from general energy formulae that the energy required to compress air to 40 psi (which allows for a pressure drop of 10 psi in the supply lines to the snow making guns of the present invention) is less than half of that required to compress air to 110 psi, the operating temperatures of prior art snow making guns. The compressors needed to compress air to 40 psi are simpler, less expensive and inherently more efficient. By enabling ski area operators to use low pressure air compressors, the apparatus of the present invention provides more than 50 percent energy savings and also extends the temperature range at which snow can be made. Moreover, the noise level of snow making apparatus according to the present invention operating at relatively low pressures is considerably lower than that for higher pressure air guns.

The simplicity of construction of the present invention also results in a substantial reduction in the total weight of the apparatus. It has been found that the apparatus, including a built in elevation mechanism, can be constructed at an operating weight of about 19 pounds.

Yet another advantage of the present invention, is that it also can be operated at higher air pressures in existing snow making operations. Many ski areas have already installed high pressure air supply systems. The apparatus of the present invention can be used with such existing systems, accepting higher pressure air than 30 psi, and still produce snow at temperatures above freezing, without a nucleator or catalyst. Moreover, it has been found that the apparatus of the present invention under those conditions will put more snow on the ground than previously proposed snow making apparatus. In tests performed by applicant, snow making guns according to the present invention were operated next to two commercially available air/water snow making guns on the same ski slope for a period of eight hours. At the end of the test period a mound of snow on the trail in front of the snow guns constructed in accordance with the present invention was 12 feet high and 120 feet long, while in front of the competitive guns the snow made was only 3 feet high. During this test all of the snow making guns were operating at 75 to 90 psig air pressure, with water pressure at 325 to 380 psig. The ambient temperature ranged from 14° to −2° F. with light winds of about five miles per hour. Water flow in the guns of the present invention averaged about 80 gallons per minute and produced substantially larger snow particles than those of the competitive guns, which could handle only 50 gallons per minute of water. Because of the heavier and larger snow particles produced with the guns of the present apparatus, much more of the snow produced by the guns landed on the ski trail rather than evaporating or being blown by the wind into the woods. The resulting snow density for all guns was about the same, i.e. 30 pounds per cubic foot on average.

It is believed that the reason for this more accurate and efficient use of the snow making water which results from the present invention lies in the droplet size of the plume produced by the apparatus of the invention. In prior art devices light particles evaporate before they hit the ground or they just blow away in a moderate breeze. The apparatus of the present invention produces heavier particles which land on the trail where they do the most good.

Yet another advantage of the present invention, for ski areas which have existing compressors and piping, is that additional snow making apparatus can be connected to the existing piping system in order to reduce pressure at each gun. This will produce some energy savings, while increasing snow making capacity.

In addition to the energy savings which is achieved by the snow making apparatus of the present invention, because of the unique large particle snow characteristic achieved with the present invention and the fact that this results in most of the snow landing on the target area rather than evaporating or blowing away, ski area operators can anticipate a savings in water consumption for each cubic foot of snow put on the ski trail. This will reduce not only the cost of water but the cost of pumping water to the snow making site.

Applicant has found that due to the unique composite and concentric configuration of the components of the apparatus, the apparatus provides a high degree of self nucleation which allows it to continue to make snow for many degrees above the ambient temperature at which all other competitive snow making guns stop making snow. This is an important asset especially in ski areas where marginal temperatures are common. Although at higher temperatures more air is used to make snow, the ability to make snow at higher temperatures at all will make a difference in certain ski areas between closing a ski trail or keeping it open.

It is believed that the improved results in snow making achieved by the apparatus of the present invention results from the optimal use of the maximum momentum of the air and water in the apparatus due to their mixing in concentric streams in the same direction and the adiabatic temperature drop during the passage through the mixing tube. The construction of the apparatus of the present invention insures and maintains the needed concentricity at all times.

In prior art snow making guns, air and water are usually made to impinge against each other so that they will break up the water into smaller particles. Thus the effective momentum of both air and water is lost. In the apparatus of the present invention high pressure water, preferably at 300 psi or more, enters the chamber or bore of the air supply body through a space between a needle valve and its associated orifice. This creates an annular jet of water which becomes thinner as the needle is turned down into the orifice. As in all snow making apparatus the air/water ratio must be increased at higher temperatures. Thus with the present invention the water jet is thinned down and atomization is enhanced at higher ambient temperatures, by turning down the needle valve.

The cylindrical water jet is introduced into the bore of the water supply body in line with the outlet air/water orifice of the air supply body. Here again the construction of the present invention assures proper spacing and orifice sizes to achieve the desired effect. In the bore of the air supply body, the water stream is surrounded by a concentric supply of the pressurized air and enters the larger discharge orifice of the air supply body with the surrounding air. Instead of being immediately dispersed into the atmosphere as in existing guns, the mixture of air and water enters a mixing tube in accordance with the present invention which has the same inside diameter as the air orifice of the air supply body. Since the air/water mixture is at a pressure which is more than twice atmospheric, the velocity of the air through the air orifice would be sonic, or about 1100 feet per second, if it were not for the presence of the added water and the mixing tube. The added water slows down the velocity of the mixture to about 800 feet per second at a typical operating condition.

During passage through the mixing tube the air and water droplets are in intimate turbulent contact and become thoroughly mixed into an amorphous mixture by the time they reach the exit of the tube. In addition, the temperature of the air during this passage through the mixture is drastically reduced in accordance with the well known laws of thermodynamics. For example, if air coming into the apparatus was at 40° F., and no water was present, the velocity of the air in the throat of the orifice would be sonic and its static temperature at this velocity would be about 62° F. below zero. At the velocity of about 800 feet per second, which is actually present in the orifice when water is injected, the static temperature of the air is about 36° F. below zero. As a result the water droplets injected into the orifice at the air supply body (which droplets range from large to microscopic in size) are in turbulent contact with this minus 36° F. air during the entire passage through the mixing tube.

The water velocity as it exits from the needle valve into the air supply body is considerably slower than the near sonic air velocity in the mixing tube. In one test operation it was found that the water velocity leaving the needle valve wa about 132 feet per second. As the air/water mixture enters the air orifice, i.e. the discharge orifice of the air supply body, the relative velocity of the fast moving air over the slower moving water is about 680 feet per second. This high relative surface velocity greatly increases the cooling effect on the water particles since the heat transfer coefficient from the water to the air is roughly a factor of the square of the surface velocity. As the water particles reach the exit of the mixing tube they will have accelerated, with the smaller particles probably reaching close to the final air velocity of 800 feet per second. While the total time of this contact is only on the order of two milliseconds, this is sufficient to transfer the heat from the water droplets to the air so that the smallest particles will actually approach the minus 36° F. air temperature by the time they reach the exit of the mixing tube. Thus practically all of the particles will be well below freezing. As a result it has been found that this gun acts as its own nucleator by producing hyper frozen crystals in the air water mixture before it leaves the gun. In one test with the subject gun it was found that snow was made at an ambient temperature of 46° F., although at this high temperature the snow flakes melted before or as they reached the ground.

The operation of the apparatus of the present invention as described above is in contrast with all existing air/water guns which mix air and water and droplets together in the open air. In these guns the air velocity in the nozzles is also sonic, but the velocity drops from 1100 feet per second to near zero in a fraction of an inch. In accordance with the laws of thermodynamics the static pressure of the air rises and returns to its initial temperature (for example 40° F.) as soon as its velocity decreases so that the water droplets are only in contact with the super cool air for micro seconds and don't have time to cool much before they are heated up again.

BRIEF DESCRIPTION OF THE DRAWINGS

The above, and other objects, features and advantages of the invention will be apparent to those skilled in the art in the following detailed description of a illustrative embodiment thereof, when read in connection with the accompanying drawings wherein:

FIG. 5 is an end view of the needle guide;

FIG. 6 is a rear end view of the water supply body;

FIG. 7 is a rear end view of the air supply body;

FIG. 8 is a rear end view of the water supply body mated with the air supply body.

DETAILED DESCRIPTION OF THE INVENTION

Figure 1:
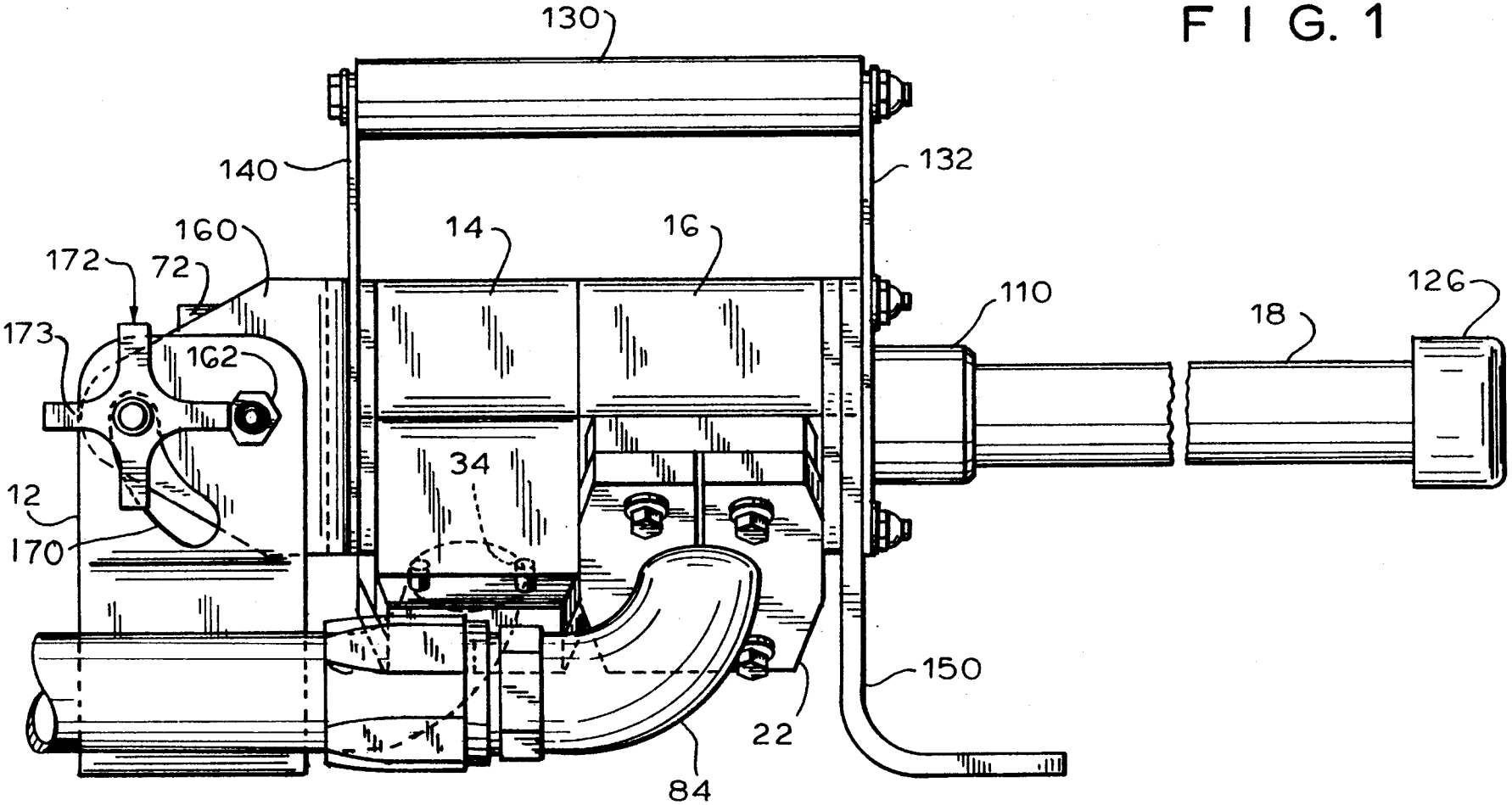
FIG. 1 is a side view of the snow making apparatus of the present invention.

Referring now to the drawings in detail, and initially to FIG. 1 thereof, a snow making apparatus or gun 10 constructed in accordance with the present invention is illustrated. The snow making gun 10 includes a mounting bracket 12 which permits the gun to be mounted on a conventional stand or other apparatus in any convenient manner. The gun includes a water supply body 14, an air supply body 16, and a mixing tube 18, all clamped together as described in detail hereinafter.

Water supply body 14 includes a water inlet port 20 for receiving pressurized water of about 300 psig. Similarly air supply body 16 includes an air inlet port 22 formed therein for receiving pressurized air on the order of 30 to 60 psig. The pressurized water and air are mixed in the air supply body and mixing tube 18, to produce snow as described above.

Figure 3:
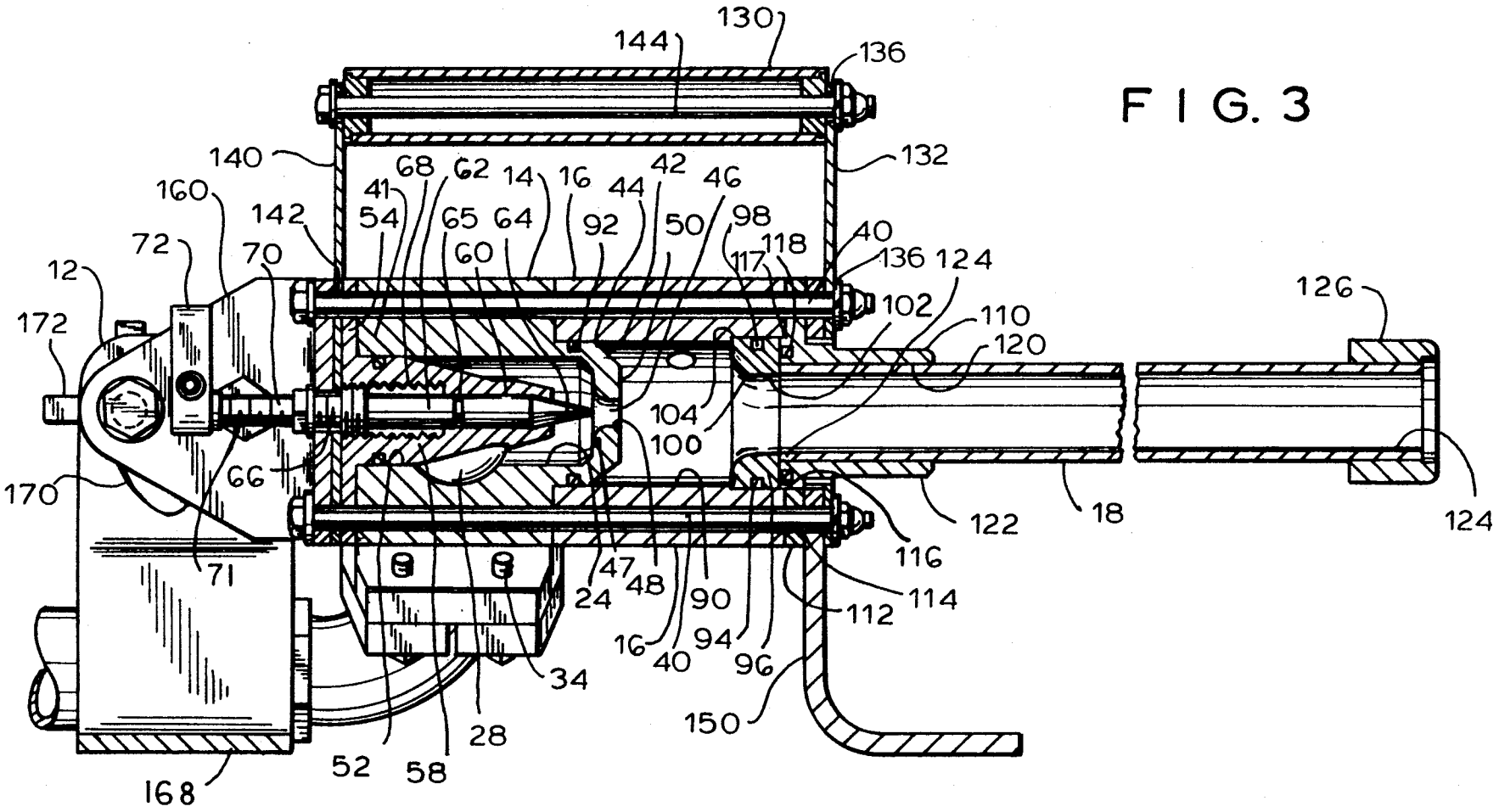
FIG. 3 is a sectional view taken along line 3—3 of FIG. 2.

Referring to FIGS. 3 and 6 of the drawing, it is seen that water supply body 14 has a generally square or polygonal cross section including an internal longitudinally extending bore 24. The water inlet port 20 of body 14 includes a generally square flange 26 through which a water supply inlet bore 28 is formed to permit pressurized water to flow from a source thereof to the interior bore 24 of the water supply body.

Figure 4:
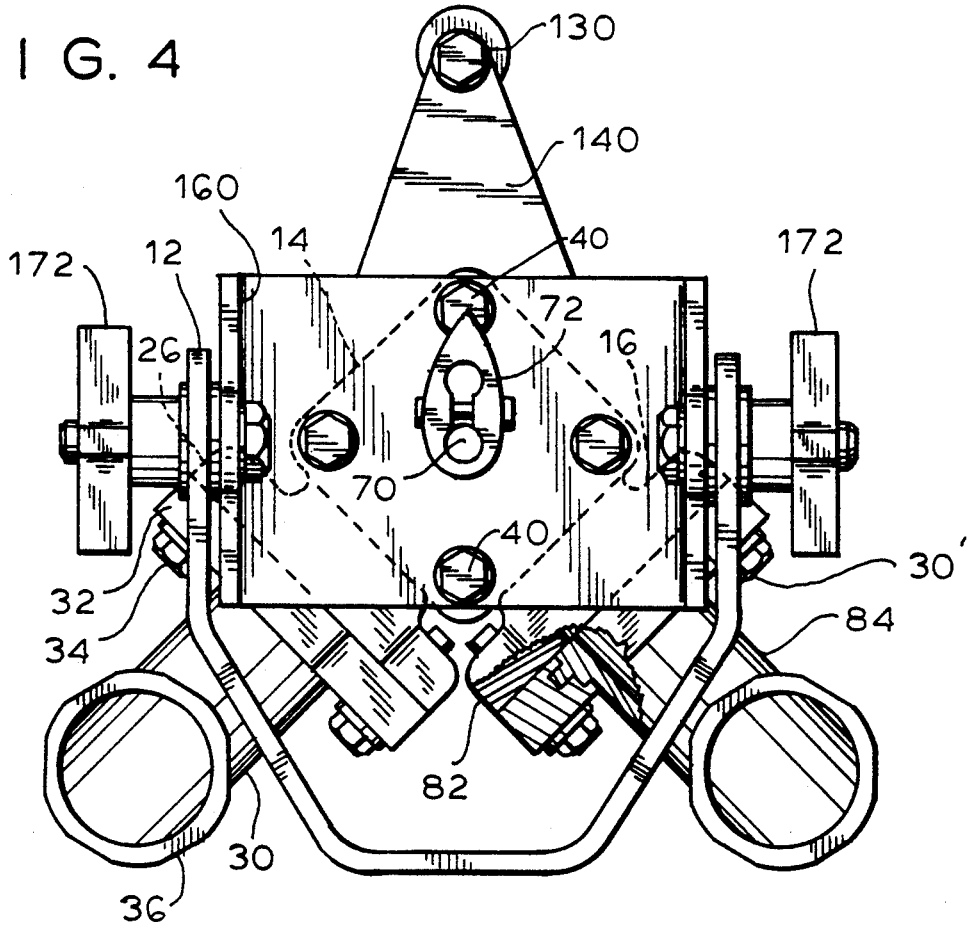
FIG. 4 is an end view of the apparatus shown in FIG. 1, with parts broken away.
Figure 9:
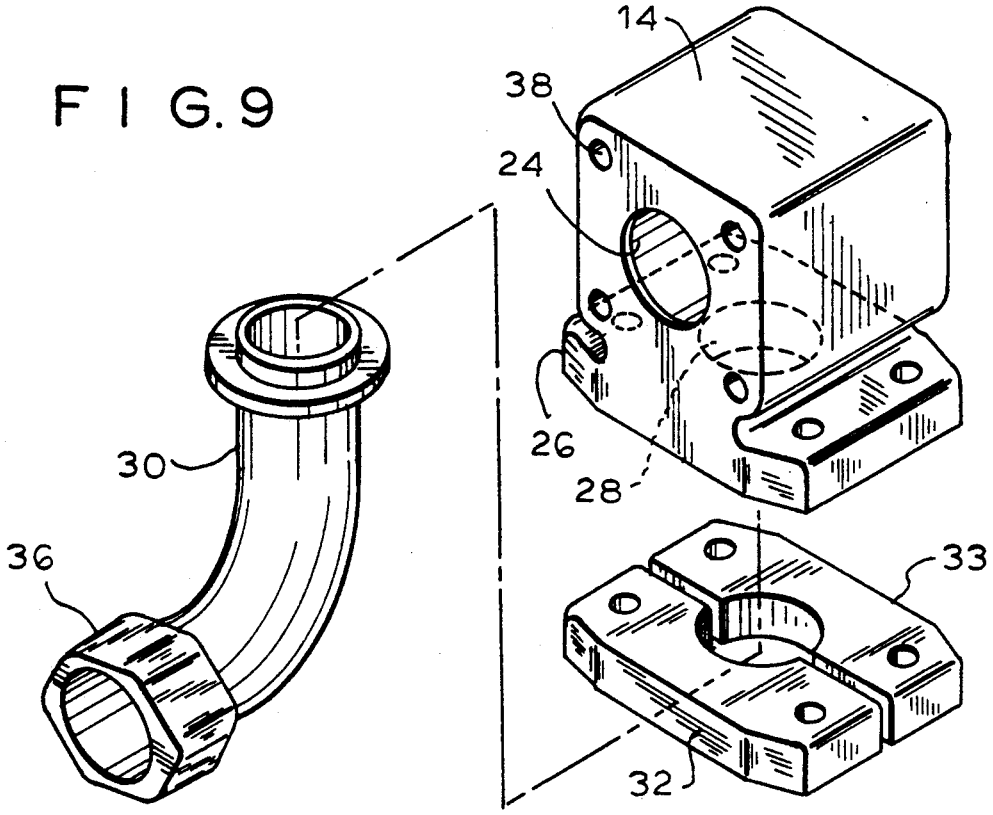
FIG. 9 is a perspective view illustrating the water supply connection to the water supply body.

Pressurized water is supplied to body 14 through an elbow 30 (FIG. 9) of conventional construction which is sealed to the flange 26 of water supply body 14 by a conventional S.A.E. water tight clamp structure 32. This clamp structure consists of a two piece clamp as illustrated in FIG. 4 and 9, bolted to the flange 26 by bolts 34 (see FIG. 3). By loosening the clamps, the angular position of elbow 30 to water supply body 14 can be adjusted. The outer end 36 of elbow 30 has a conventional threaded coupling for attachment to a pressurized water supply line or hose in the conventional manner.

Water supply body 14 has a plurality of through bores 38 formed therein, at the corners of the square or polygonal cross section, which receive clamping bolts 40 that serve to clamp the assembly together as described hereinafter.

As seen in FIG. 3 the internal longitudinally extending bore 24 of water supply body 14 extends to the rear end 41 of the body 14 to define an open rear end. The front end 42 of water supply body 14 has a cylindrical boss or extension 44 formed therein including a rounded edge orifice 46 longitudinally aligned with the longitudinal axis of the water supply body. The rounded edge orifice 46 includes an approach 47 which curves from an internal larger diameter equal to that of bore 24 to a smaller diameter throat 48 at the face 50 of the water supply body.

The rear end of the water supply body is closed by a needle valve guide housing 52. As seen in FIG. 5 needle guide housing 52 has a generally square or rectangular flange 54 that is complementary to the general shape of water supply body 14 and has through bores 56 formed therein. The needle guide housing includes a needle guide section 58 which is generally circular in cross section and is received within bore 24 of water supply body 14 in concentric relation thereto. As seen in FIG. 3 the needle guide housing section 58 tapers to permit water supplied through port 28 in the water supply body to flow around the section 58.

Section 58 of the needle guide housing includes an internal bore 60 which receives the needle valve 62. The latter has a tapered forward end portion 64 that extends out of the front end of the needle guide housing to a position adjacent the orifice 46. Preferably the needle point or end 64 has an included angle of 30°.

An O ring 65 is mounted on the forward end of the needle valve to provide a water tight seal between the needle and the bore of the needle guide housing. Rearwardly of O ring 65 the needle valve includes a threaded boss 66 that threadedly engages the internal threaded surface segment 68 of bore 60.

The rear end 70 of needle valve 60 extends outwardly of the needle guide housing and and includes a knob or crank 72. By turning knob 72 the needle valve is rotated and the position of the front end 64 of the needle is adjusted relative to the orifice in order to control the water flow rate into the air supply body 16. As mentioned above, at higher ambient temperatures a higher air/water ratio, is required to make snow and this needle valve permits the control of the air supply ratio.

In accordance with a feature of the present invention the rear end 70 of the needle valve may be calibrated by inscribed markings 71 or the like in any convenient manner to permit the operator to determine the water supply flow through the orifice 46 of the water supply body.

With the construction of the water supply body and the needle guide housing as described above, pressurized water introduced into the water supply body is discharged through the orifice 46 in a controlled cylindrical high pressure stream which is directed along the axis of air supply body 16 into the mixing tube 18.

As seen in FIG. 7, air supply body 16 has substantially the identical external cross-sectional configuration as that of water supply body 14. In fact, to assure optimal alignment of these two bodies, it is preferred that they are formed from the same extruded aluminum stock material. After extrusion, the stock is cut and the internal bores machined therein using known numerical control techniques.

Air supply body 16 includes an air inlet port 80 formed through its flange 82. Air is supplied to port 80 through an elbow 84 (see FIG. 2) which is clamped to flange 82 in the same manner as described above with respect to the elbow and clamp 30, 32 for the water supply housing. In addition, air supply body 16 has through bores 84 formed therein which align with bores 38 of water supply body so that the bodies can be clamped together by the bolts 40. Preferably, as illustrated in FIG. 8, water supply body 14 and air supply body 16 are positioned at a 90° angle relative to each other so that their water and air supply inlet ports are located downwardly. Thus the device will be self-draining. However, for specific applications, it may be desirable to have the inlet ports located at other relative angles. By having the bores 38, 84 equally spaced radially, the gun is easily disassembled and allows the position of the two bodies to be varied.

Referring again to FIG. 3, it is seen that the air supply body 16 includes an internal longitudinally extending bore 90. The internal diameter of this bore is substantially equal to the external diameter of the extension 44 of water supply body 14. That extension includes an O ring 92 mounted therein to form a water and air tight seal between the two bodies. As a result of this construction the extension sleeve 44 serves as a pilot for the water supply body in the air supply body and insures that the orifice 46 is concentric with the longitudinal axis of the air supply body.

Air supply body 16 additionally includes an undercut portion 94 of slightly larger diameter than the bore 90. The bore portion 94 receives a rounded edge orifice ring 96. This ring has an external diameter which is substantially equal to the diameter of the bore portion 94 and includes an O ring 98 mounted therein to form an air and water tight seal therebetween. Orifice ring 96 includes an approach 100 which curves from a larger diameter (approximately equal to that of bore 90) located adjacent the shoulder 104, between the bore sections 90 and 94, to a smaller diameter throat 102 downstream in the air supply body. The bore section 94 and the orifice ring 96 ar dimensioned such that the orifice 100 is concentric with the longitudinal axis of the air supply body and thus with the cylindrical water supply stream ejected from the orifice 46. As a result of this construction, the cylindrical water supply stream ejected from the orifice 46 of the water supply body enters the larger orifice 100 surrounded by the pressurized air supplied by the air supply body. As described above, as the pressurized air passes through the constricting orifice 100, its speed approaches sonic speeds, and its effective static temperature falls to minus 36° F., creating self nucleation and snow. Preferably, the distance between the throats 48, 102 of the orifices is between 1-½ and 3 times and optionally about two times the diameter of the throat 102 of the air orifice.

If desired, both water supply body 14 and air supply body 16 can have pressure gauge ports 106 formed therein to enable the operators to thread in a pressure gauge to determine the pressures in these bodies thereby to test and effectively control operation of the snow making gun. Additionally, the orifice 100 may be formed integrally with the mixing tube bracket 110 described hereinafter.

Mixing tube 18 is mounted in the forward end of air supply body 16 by a mixing tube bracket 110. The mixing tube bracket is generally cylindrical but has a rectangular flange 112, corresponding generally in dimension to the flange 52 of the needle guide housing illustrated in FIG. 6. This flange has bores 114 formed therein for receiving bolts 40. The rear end 116 of the mixing tube bracket has a generally cylindrical pilot or extension 117 formed thereon. The inner face of this pilot or extension 117 includes a groove 118 containing an O ring to form a seal between it and the front face of the orifice ring 96. The rear end portion 120 of mixing tube 18 is received within the internal bore 122 of the mixing tube bracket 110 with its rear face 124 flush and square with the rear face of the mixing tube bracket. In order to secure tube 18 within bracket 110 the tube is glued within the bracket using any conventional adhesive suitable for purpose, and particularly for example Scotch weld adhesive identified by the manufacturers number 3M 2216 B/A.

The internal diameter of the mixing tube bracket 110 is selected to be substantially equal to the external diameter of mixing tube 18. The internal diameter of mixing tube 18 is selected to be identical to the smallest diameter of orifice ring 96 (and is preferably 1-⅛ inches in diameter) so that a smooth transitional flow is achieved from the orifice to and through the mixing tube. As described above the mixture of air and water in the tube passes through the tube at relatively high speeds and causes freezing of the water particles within the tube. These particles are discharged from the forward end 124 of tube 18 to the atmosphere. Preferably the end of this tube is surrounded by a nose guard ring 126 formed of rubber of the like.

By this arrangement of the water supply and air supply bodies with the concentric orifices, a maximum conservation of energy is achieved by the introduction of both air and water in concentric streams in the same direction. The adjustable needle valve which controls the water flow through the rounded orifice 46 forms the thin cylindrical stream which becomes thinner and atomizes the water more thoroughly as the needle valve is turned down to reduce flow, as required during high ambient temperatures. As noted above, orifice 96 is preferably located between one and one-half or three throat diameters downstream from orifice 46. The mixing tube has a length of between 10 and 30 inches. This length is sufficient to super cool the smaller water droplets created by the needle valve and its orifice.

To maintain the various components described above in assembled and concentric relationship, bolts 40 are provided which pass through the various through bores 56, 38, 84 etc. previously described. The equal spacing of the bolts about the center line of the gun permits the gun to be easily disassembled for repair or repositioning of the air and water supply bodies angularly with respect to each other, and then to be reassembled while assuring maintenance of the necessary concentricity of the various ports and orifices.

Figure 2:
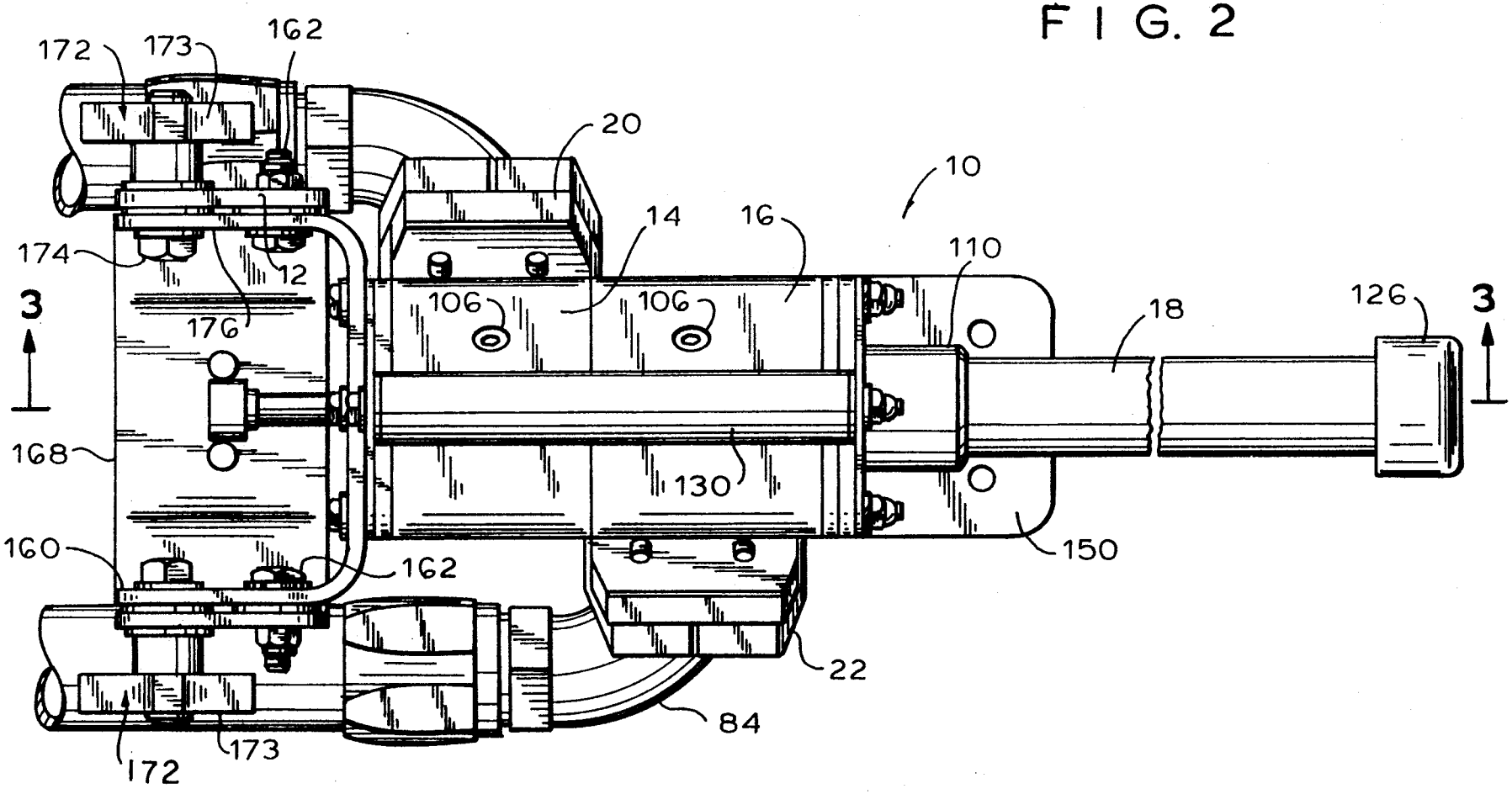
FIG. 2 is a top plan view of the apparatus shown in FIG. 1.

Preferably, the snow making gun of the present invention is provided with a handle 130 which is also held in place by bolts 40. As illustrated in FIGS. 3 and 4 the handle includes a front plate 132 having bores 136 therein for receiving bolts 40 and a rear plate 140, also having bores 142 formed therein for receiving the bolts. The upper ends of plates 132, 140 receive therebetween the handle 130, which is held in place by a bolt 144. Preferably, a front support stand or foot 150 is assembled by one or more of the bolts 40 at the front end of the gun, as illustrated in FIGS. 2 and 3.

The rear of the snow making gun of the present invention includes the bracket assembly 1 mentioned above. This bracket assembly includes a U-shaped frame member 160 (see FIGS. 2 and 3) pivotally connected by bolts 162 to a second U-shaped frame member or bracket 168. The latter has arcuate slots 170 formed therein. Threaded clamps 172 are provided to adjustably lock the position of member 160 relative to bracket 168. This includes bolts 174 which extend through the bracket slots 170 to the legs 176 of the bracket 160. Bolts 174 have handles 173 on their ends for manual tightening and loosening. By loosening clamps 172, the position of the bracket 160 (and thus of the gun itself) relative to the bracket 168 ca be adjusted. Thus the angle of the mixing tube 18 relative to the horizontal can be adjusted to effect the discharge or pattern of discharge of the snow. The bracket 168 may be mounted on any supporting device, such as a tripod or a sled, in any convenient or known manner. In addition, the elevation pivot point defined by bolts 162 is in line with the center line of thrust of the gun so that the thrust produced when the gun is in operation does not affect a change in the elevation angle.

Accordingly it is seen that by the construction of the present invention a new and improved snow making apparatus is provided which is light weight in construction, is capable of producing snow at high ambient temperatures, but with low air pressure. The gun produces snow without the need for the use of nucleating devices or agents, and in a single stage construction. It is light weight and efficient in operation and produces high quality and high quantities of snow. Operation of the apparatus greatly reduces energy costs with distribution of air and is of great economic value to ski operators.

Although an illustrative embodiment of the present invention has been described herein with reference to the accompanying drawings, it is to be understood that various changes and modifications may be effected therein by one skilled in the art without departing from the scope of spirit of this invention.

What is claimed is:

1. Apparatus for producing snow comprising, a plurality of components aligned along a longitudinal axis, said components including a first hollow body having a water inlet port and a rounded edge water outlet orifice, said water outlet orifice being located in said body concentric to said axis, said outlet orifice having an approach which curves from a first large diameter in said body to a smaller diameter throat at the face of the orifice, a needle guide housing contained at least partly in said first body concentric therewith, a needle valve movably mounted in said needle guide housing and having a tapered end extending from said housing towards said orifice; means for selectively adjusting the needle in said needle guide housing for adjusting the position of s id tapered end with respect to said orifice, thereby to control the flow of water from said body through said orifice; a second hollow body having front and rear ends and arranged concentrically with said first body, said second body receiving within its rear end said orifice of the first body and having an air inlet port formed therein and a rounded edge outlet orifice in the front end of said second body for discharging a mixture of air and water from said second body, said outlet orifice in the second body having an approach which curves from a first diameter to a smaller diameter throat downstream of the first diameter; a mixing tube bracket having a piloted inner end portion received in the front end of said second body concentrically therewith, a mixing tube having an internal diameter equal to the second diameter of the throat in said second body and being mounted in said bracket concentrically therewith; and means for clamping said needle guide, first and second bodies, and said mixing tube bracket together in a composite structure.

2. Apparatus as defined in claim 1 including means positioned between said needle guide housing and said first body, between said first and second bodies, between said second body and the outlet orifice in the second body, and between said outlet orifice in the second body and said mixing tube bracket for forming a air and water tight seal therebetween.

3. Apparatus as defined in claim 1 including bracket means for mounting said apparatus on a support.

4. Apparatus as defined in claim 3 including means on said bracket means for adjustably mounting said apparatus to vary the angular inclination thereof.

5. Apparatus as defined in claim 1 including a handle mounted on said apparatus.

6. Apparatus as defined in claim 5 wherein said handle is secured to said apparatus by said clamp means.

7. Apparatus as defined in claim 1 wherein said needle includes a rear end portion extending out of said first body and said needle guide and a control crank mounted on said rear end portion to permit an operator to turn said needle and adjust its position in said tube.

8. Apparatus as defined in claim 7 wherein said rear end portion of the needle is calibrated to permit visual determination of the position of the needle's tapered end portion relative to the orifice in said first body.

9. Apparatus as defined in claim 1 wherein said first and second bodies have complementary external configurations whereby their relative angular positions may be varied.

10. Apparatus as defined in claim 1 wherein said first and second bodies are polygonal in cross section and complementary, said bodies having complementary through bores formed therein and said clamp means including a plurality of bolts passing through said through bores, whereby the relative angular position of said bodies may be varied.

11. Apparatus for producing snow comprising a water supply body having front and rear ends, a water inlet port and a longitudinally extending bore formed therein, said bore being open at the rear end of the water supply body and shaped at the front end of said body to define an integral converging water discharge orifice at the front end of the body; a needle guide housing mounted in the bore of said water supply body and closing the rear end thereof, a needle valve movably mounted in said needle guide housing and having a tapered end extended from said housing towards said discharge orifice; means connected to said needle valve and extending therefrom out of said needle guide housing and said water supply body for selectively adjusting the position of the needle valve in said housing relative to said discharge orifice during the operation of the apparatus thereby to adjust the position of said tapered end with respect to said orifice and to control and selectively vary water flow therethrough during operation of the apparatus; an air supply body having front and rear ends; an air inlet port and a longitudinally extending bore formed therein, said air supply body being engaged with said water supply body with the bores thereof in longitudinal alignment and with the water discharged orifice of the water supply body spaced rearwardly of the front end of the air supply body whereby air and water are contacted in the bore of the air supply body; an outlet orifice in the front end of said air supply body for discharging a mixture of air and water from the bore of the air supply body; a mixing tube mounted on said air supply body in concentric alignment with said outlet orifice therein; and means for clamping said water supply and air supply bodies together.

12. Apparatus for producing snow comprising a water supply body having front and rear ends, a water inlet port and a longitudinally extending bore formed therein, said bore being open at the rear end of the water supply body and shaped at the front of said body to define an integral converging discharge orifice at the front end of the body; a needle guide housing mounted in the bore of said water supply body enclosing the rear end thereof, a needle valve movably mounted in said needle guide housing and having a tapered end extending from said housing towards said discharge orifice; means for selectively adjusting the position of the needle in said housing thereby to adjust the position of said tapered e end with respect to said discharge orifice and control water flow therethrough; an air supply body having front and rear ends, an inlet port and a longitudinally extending bore formed therein, said air supply body being engaged with said water supply body with the bores thereof in longitudinal alignment; an outlet orifice in the front end of said air supply body for discharging a mixture of air and water from the second body; a mixing tube mounted on said air supply body in concentric alignment with said outlet orifice therein; and means for clamping said water supply and air supply bodies together; said water supply body having a reduced external diameter adjacent its front end which is equal to the internal diameter of said air supply body and which is received in said air supply body thereby to axially align the orifice of said water supply body with the bore of the air supply body.

13. Apparatus for producing snow comprising a water supply body having front and rear ends, a water inlet port and a longitudinally extending bore formed therein, said bore being open at the rear end of the water supply body and shaped at the front of said body to define an integral converging discharge orifice at the front end of the body; a needle guide housing mounted in the bore of said water supply body enclosing the rear end thereof, a needle valve movably mounted in said needle guide housing and having a tapered end extending from said housing towards said discharge orifice; means for selectively adjusting the position of the needle in said housing thereby to adjust the position of said tapered e end with respect to said discharge orifice and control water flow therethrough; an air supply body having front and rear ends, an inlet port and a longitudinally extending bore formed therein, said air supply body being engaged with said water supply body with the bores thereof in longitudinal alignment; an outlet orifice in the front end of said air supply body for discharging a mixture of air and water from the second body; a mixing tube mounted on said air supply body in concentric alignment with said outlet orifice therein; and means for clamping said water supply and air supply bodies together; and a mixing tube, said mixing tube having an internal diameter equal to the smaller diameter of the discharge orifice in the air supply body and said body having a pilot sleeve formed thereon at its rear end whose external diameter equals the internal diameter of the front end of the air supply body and is received therein thereby to actually align the bore of the mixing tube with the discharge orifice of said air supply body.

14. Apparatus for producing snow comprising a water supply body having front and rear ends, a water inlet port and a longitudinally extending bore formed therein, said bore being open at the rear end of the water supply body and shaped at the front of said body to define an integral converging discharge orifice at the front end of the body; a needle guide housing mounted in the bore of said water supply body enclosing the rear end thereof, a needle valve movably mounted in said needle guide housing and having a tapered end extending from said housing towards said discharge orifice; means for selectively adjusting the position of the needle in said housing thereby to adjust the position of said tapered e end with respect to said discharge orifice and control water flow therethrough; an air supply body having front and rear ends, an inlet port and a longitudinally extending bore formed therein, said air supply body being engaged with said water supply body with the bores thereof in longitudinal alignment; an outlet orifice in the front end of said air supply body for discharging a mixture of air and water from the second body; a mixing tube mounted on said air supply body in concentric alignment with said outlet orifice therein; and means for clamping said water supply and air supply bodies together; said air supply bodies being complimentary in cross section and having complimentary through bores formed therein, said clamp means including a plurality of bolts respectively passing through said through bores, whereby the relative angular positions of said bodies may be varied without effecting the alignment of the orifices therein.

15. Apparatus for producing snow comprising a water supply body having front and rear ends, a water inlet port and a longitudinally extending bore formed therein, said bore defining an integral water discharge orifice at the front end of the body; a needle valve assembly mounted in the rear end of the water supply body including an adjustable needle concentrically aligned with said discharge orifice to control water flow through the discharge orifice; means connected to said needle and extending therefrom out of the needle valve assembly and said water supply body for selectively adjusting the position of the needle in said assembly relative to said discharge orifice during operation of the apparatus thereby to control and selectively vary water flow through the orifice during operation of the apparatus; an air supply body having front and rear ends, an air inlet port and a longitudinally extending bore formed therein, said bore of the air supply body being dimensioned to receive the front end of the water supply to concentrically align the discharge orifice of the water supply body with the bore of the air supply body in spaced relation to the front end of the air supply body whereby water and air are contacted within the bore of the air supply body; means defining an outlet orifice mounted in the bore of the air supply body, a mixing tube mounted on said air supply body in concentric alignment with the outlet orifice therein, and means for clamping said water supply body, said air supply body, said discharge orifice in the air supply body, and said mixing tube together.

16. Apparatus for producing snow comprising a water supply body having front and rear ends, a water inlet port and a longitudinally extending bore formed therein, said bore defining an integral water discharge orifice at the front end of the body; a needle valve assembly mounted in the rear end of the water supply body including an adjustable needle concentrically aligned with said orifice to control water flow through the orifice; an air supply body having front and rear ends, an air inlet port and a longitudinally extending bore formed therein, said bore of the air supply body being dimensioned to receive the front end of the water supply body to concentrically align the orifice of the water supply body with the bore of the air supply body; means defining an outlet orifice mounted in the bore of the air supply body, a mixing tube mounted on said air supply body in concentric alignment with the orifice therein, and means for clamping said water supply body, said air supply body, and said orifice in the air supply body, and said mixing tube together; said air supply body having an enlarged diameter portion formed therein adjacent to the front end thereof, said means defining an outlet orifice comprising a ring mounted in said enlarged diameter portion of the water supply body concentrically with the longitudinally axis thereof.

17. Apparatus as defined in claim 16 including a mixing tube bracket having front and rear ends and a longitudinal bore formed therein, said mixing tube being mounted in said bore and having a rear end flush with the rear end of the mixing tube bracket, said mixing tube having an internal diameter equal to the smaller diameter of the orifice throat in the air supply body and said bracket having a pilot sleeve formed thereon at its rear end whose external diameter equals the internal diameter of the front end of the air supply body and is received therein thereby to axially align the bore of the mixing tube with the orifice of said air supply body.

18. Apparatus as defined in claim 17 wherein said water and air supply bodies are complimentary in cross-section and have complementary through bores formed therein, said clamp means including a plurality of bolts respectively passing through said through bores, whereby the relative angular positions of said bodies may be varied without effecting the alignment of the orifices therein.

19. Apparatus as defined in claim 18 wherein said mixing tube bracket and said needle valve assemblies have radial flanges formed thereon including bore hole therein which receive said bolts whereby all of said needle valve assembly, water and air supply bodies, means defining an orifice, and mixing tube bracket are clamped together in longitudinal alignment.

20. Apparatus as defined in claim 19 including bracket means for mounting said apparatus on a support.

21. Apparatus as defined in claim 20 including means on said bracket means for adjustably mounting said apparatus to vary the angular inclination thereof.

22. Apparatus as defined in claim 21 including a handle mounted on said apparatus.

23. Apparatus as defined in claim 22 including means on said bracket means for adjustably mounting said apparatus to vary the angular inclination thereof.

* * * * *